US008604264B2

(12) United States Patent
Ledoux et al.

(10) Patent No.: US 8,604,264 B2
(45) **Date of Patent: *Dec. 10, 2013**

(54) METHOD FOR PROCESSING A NITROUS AQUEOUS LIQUID EFFLUENT BY CALCINATION AND VITRIFICATION

(75) Inventors: Alain Ledoux, Bagnols sur Ceze (FR); Jean-François Hollebecque, Villeneuve les Avignon (FR)

(73) Assignee: Areva NC, Paris (FR)

( * ) Notice: Subject to any disclaimer, the term of this patent is extended or adjusted under 35 U.S.C. 154(b) by 164 days.

This patent is subject to a terminal disclaimer.

(21) Appl. No.: 13/142,804

(22) PCT Filed: Dec. 23, 2009

(86) PCT No.: PCT/EP2009/067899

§ 371 (c)(1), (2), (4) Date: Aug. 30, 2011

(87) PCT Pub. No.: WO2010/076286

PCT Pub. Date: Jul. 8, 2010

(65) Prior Publication Data

US 2011/0306817 A1 Dec. 15, 2011

(30) Foreign Application Priority Data

Dec. 30, 2008 (FR) ..... 08 59134

(51) Int. Cl.
*G21F 9/14* (2006.01)

(52) U.S. Cl.
USPC ..... 588/19

(58) Field of Classification Search
USPC ..... 588/2, 11, 18, 19
See application file for complete search history.

(56) References Cited

U.S. PATENT DOCUMENTS

| | | | | |
|---|---|---|---|---|
| 3,008,904 | A * | 11/1961 | Johnson, Jr. et al. | 588/2 |
| 3,272,756 | A | 9/1966 | Kaser | |
| 3,943,062 | A | 3/1976 | Wielang et al. | |
| 4,164,479 | A | 8/1979 | Newby | |
| 4,514,329 | A | 4/1985 | Wakabayashi et al. | |
| 2008/0281141 | A1 | 11/2008 | Pinet et al. | |
| 2009/0326312 | A1 | 12/2009 | Boen et al. | |

FOREIGN PATENT DOCUMENTS

| | | |
|---|---|---|
| CA | 1044015 | * 12/1978 |
| CN | 101218182 | 7/2008 |
| JP | 53-109100 | * 9/1978 |
| WO | 2008/040773 | 4/2008 |

OTHER PUBLICATIONS

International Search Report and Written Opinion in International Application No. PCT/EP2009/067899, mailed Jul. 7, 2010.
French Search Report in French Patent Application No. FR 0859134, dated Oct. 1, 2009.
International Preliminary Report on Patentability in International Application No. PCT/EP2009/067899, dated Apr. 11, 2011.
Chinese Office Action in Chinese Application No. 200980152167.7, dated Jul. 22, 2013.

* cited by examiner

*Primary Examiner* — John Kreck
(74) *Attorney, Agent, or Firm* — Nixon Peabody LLP

(57) ABSTRACT

A method for treating a nitric aqueous liquid effluent containing nitrates of metals or metalloids, comprising a step for calcination of the effluent in order to convert the nitrates of metals or metalloids into oxides of said metals or metalloids, at least one compound selected from the nitrates of metals or metalloids and the other compounds of the effluent leading upon calcination to a tacky oxide, and a dilution adjuvant leading upon calcination to a non-tacky oxide being added to the effluent prior to the calcination step, a method wherein the dilution adjuvant comprises aluminium nitrate and at least one nitrate selected from iron nitrate and rare earth nitrates.

7 Claims, No Drawings

METHOD FOR PROCESSING A NITROUS AQUEOUS LIQUID EFFLUENT BY CALCINATION AND VITRIFICATION

CROSS-REFERENCE TO RELATED PATENT APPLICATION

The present application is a National Stage Application of International Application No. PCT/EP2009/067899 entitled "Method For Processing A Nitrous Aqueous Liquid Effluent By Calcination And Vitrification" filed Dec. 23, 2009, which claims priority of French Patent Application No. 08 59134, filed Dec. 30, 2008, the contents of which are incorporated herein by reference in their entirety.

The invention relates to a method for treating a nitric aqueous liquid effluent generally containing in majority sodium nitrate with nitrates of metals or metalloids, which comprises a calcination step generally followed by a step for vitrification of the calcinate, calcine, obtained during said calcination step.

The technical field of the invention may generally be defined as that of the calcination of liquid effluents, more particularly the technical field of the invention may be defined as that of the calcination of radio-active liquid effluents with view to their vitrification.

The French method for vitrification of radio-active liquid effluents includes two steps. The first step is a step for calcination of the effluent during which drying and then denitration of a portion of the nitrates occurs, the second step is a vitrification step by dissolution in a confinement, containment, isolation glass of the calcinate produced during the calcination step.

The calcination step is generally carried out in a rotating tube heated up to 400° C. by an electric oven. The solid calcinate is milled by a loose bar placed inside the rotating tube.

During the calcination of certain solutions, in particular solutions rich in sodium nitrate, in other words solutions with a high sodium content in a nitric medium, adhesion of the calcinate on the walls of the rotating tube may be observed which may lead to total clogging of the tube of the calciner.

The answer to this consisted of adding to the effluent a compound notoriously known to be non-tacky, aluminium nitrate, in order to allow their calcination while avoiding clogging of the calciner.

But this aluminium nitrate added to the effluent increases the amount of glass to be produced. Indeed, the presence of alumina in the glass increases its elaboration temperature and leads to limiting the load level of the waste, effluent in the glass, so as not to degrade the confinement, containment properties of this glass.

The aluminium content in the glass should therefore not be too high and is generally limited to about 15% by mass expressed as $Al_2O_3$.

The amount of aluminium nitrate to be added is moreover difficult to optimize, thus for each new effluent, several tests are necessary for determining the operating calcination conditions in the heated rotating tube with which tube cloggings may be avoided. Especially, the heating of the calcination oven and the amounts of calcination adjuvant which is different from the dilution adjuvant and which is very often sugar, have to be adjusted.

Therefore, considering the foregoing, there exists a need for a method for treating by calcination a nitric aqueous effluent containing compounds, such as nitrates of metals or metalloids and other compounds, which may form tacky oxides during their calcination, which gives the possibility of avoiding adhesion of the calcinate, calcine, on the walls of the calcination tube and clogging of this calcination tube and which simultaneously limits the increase in the amount of confinement, containment glass to be produced during the vitrification of the calcinate.

More particularly, there exists a need for a method for treating effluents which may cause adhesion during, upon, their calcination, applying a dilution adjuvant, which while avoiding the adhesion of the calcinate on the walls of the calcination apparatus and clogging of the latter, in at least one way as efficient as with aluminium nitrate, does not increase like the latter, the amount of glass to be produced, and does not limit the waste load level of the glass.

There especially exists a need for a method for treating effluents containing compounds, such as nitrates of metals or metalloids and other compounds, generating tacky oxides during, upon, their calcination, in particular solutions with a high sodium nitrate content, which avoids clogging of the calcination tube and decreases the requirements, constraints imposed on the glass-making formulation, these requirements, constraints being due to the provision of aluminium in the form of aluminium nitrate in the calcination adjuvant.

The goal of the present invention is to provide a method for treating a nitric aqueous liquid effluent containing metal or metalloid nitrates, this method comprising a step for calcination of the effluent in order to convert the metal or metalloid nitrates into their oxides which i.a. meet the needs mentioned above.

The goal of the present invention is further to provide such a method which does not have the drawbacks, limitations, defects and disadvantages of the methods of the prior art and which solves the problems of the methods of the prior art, especially of the methods using aluminium nitrate as a dilution adjuvant.

This goal, and further other ones are achieved, according to the invention with a method for treating a nitric aqueous liquid effluent containing nitrates of metals or metalloids, comprising a step for calcination of the effluent in order to convert the nitrates of metals or metalloids into oxides of said metals or metalloids, at least one compound selected from the nitrates of metals or metalloids and the other compounds of the effluent leading upon, during, calcination to a tacky oxide, and a dilution adjuvant leading upon, during, calcination to a non-tacky oxide, being added to the effluent prior to the calcination step, a method wherein the dilution adjuvant comprises aluminium nitrate and at least one nitrate selected from iron nitrate and rare earth nitrates.

Advantageously, the dilution adjuvant consists of aluminium nitrate and of at least one other nitrate selected from iron nitrate and rare earth nitrates.

The method according to the invention is fundamentally characterized by the application, use, during, upon, calcination, of a particular dilution adjuvant which comprises in addition to aluminium nitrate, at least one specific nitrate selected from iron nitrate and rare earth nitrates.

The use of iron nitrate or of a rare earth nitrate in a dilution adjuvant added to a nitric aqueous liquid effluent prior to the calcination of this effluent has hitherto never been mentioned nor brought up.

Surprisingly it was found that iron nitrate and rare earth nitrates had properties for limiting the adhesion of the calcinate, close to those of aluminium nitrate, but that the oxides derived from said specific nitrates, which are so-called "non-tacky"oxides may also be dissolved into the final glass produced during the subsequent vitrification step.

The application of a dilution adjuvant comprising a nitrate selected from iron nitrate and rare earth nitrates as a substitution for a portion of the aluminium nitrate therefore gives the possibility of avoiding clogging of the tube of the calcination apparatus during, upon the calcination of effluents generating very tacky oxides, such as solutions with a high sodium content, while minimizing the increase in the amount of confinement, containment glass to be produced during the vitrification step which generally follows calcination.

It may be stated that, surprisingly, iron nitrate and rare earth nitrates all have the excellent properties of aluminium nitrate as to its capability of limiting adhesion of the calcinate, and therefore as regards avoiding clogging of the calcination tube, and have an advantage as regards the reduction in the amount of glass to be produced and the increase in the load level of waste incorporated into the glass.

The constraints, requirements imposed on the glass-making formulation by the dilution adjuvants according to the invention comprising, as a substitution for a portion of the aluminium nitrate, at least one specific nitrate selected from iron nitrate and rare earth nitrates, are significantly reduced with respect to the dilution adjuvants only consisting of aluminium nitrate because of the lower or even zero provision of aluminium.

The rare earth nitrates are generally to be selected from lanthanum nitrate, cerium nitrate, praseodymium nitrate, and neodymium nitrate; and therefore the dilution adjuvant may advantageously comprise aluminium nitrate and at least one other nitrate selected from iron nitrate, lanthanum nitrate, cerium nitrate, praseodymium nitrate and neodymium nitrate.

Still advantageously, the dilution adjuvant consists of aluminium nitrate and of at least one other nitrate selected from iron nitrate, lanthanum nitrate, cerium nitrate, praseodymium nitrate and neodymium nitrate.

A more preferred dilution adjuvant according to the invention consists of aluminium nitrate and iron nitrate.

Another more preferred dilution adjuvant according to the invention consists of aluminium nitrate, lanthanum nitrate, neodymium nitrate, cerium nitrate and praseodymium nitrate.

The respective amounts of each of the aluminium, iron and rare earth nitrates are free from the point of view of their efficiency for preventing adhesion of the calcinate in the tube and may therefore be adjusted according to their impact on the properties of the confinement, containment glass prepared in a subsequent vitrification step.

The amount of dilution adjuvant added to the liquid effluent depends on the tacky compounds contents of the liquid effluent (nitrates and/or other compounds), expressed in terms of oxides, on the total mass of the nitrates (or possibly, more specifically, of the total mass of the salts), also expressed in terms of oxides, contained in the effluent.

Generally the effluent mainly consists of a mixture of nitrates of metals and metalloids with a majority of sodium nitrate and may also contain an amount of aluminium, iron and rare earth nitrates in insufficient levels for avoiding clogging of the tube during, upon, the calcination step.

The effluent may also contain "tacky"or "non-tacky"compounds which are not nitrates, generally present as salts, such as phosphomolybdic acid which is a so-called "tacky"compound.

The method according to the invention because of the application of the specific dilution adjuvant mentioned above allows calcination without clogging of all kinds of effluents, regardless of their nature and of the nature of the nitrates and tacky nitrates which are contained therein.

The liquid effluent treated by the method according to the invention contains at least one compound such as a metal or metalloid nitrate leading upon, during calcination to a so-called "tacky"oxide, such as sodium nitrate, and/or another compound (which is not a nitrate) leading during calcination to a so-called "tacky"oxide.

In the present description, the terms of "tacky compounds", "tacky oxides"or else "tacky nitrates"are used.

By "tacky compounds", "tacky nitrates"or "tacky oxides"are meant compounds, oxides, nitrates known for adhering to the walls of calcination apparatuses, "calciner", and inducing clogging phenomena of these calciners.

The terms of "tacky compounds", "tacky oxide", "tacky nitrate"are terms currently used in this technical field, which have a well established meaning, which are known to the man skilled in the art and have no ambiguity for him.

Thus, the compound(s), such as nitrate(s) and/or other compound(s), which, upon, during calcination lead(s) to tacky oxide(s) may be selected from sodium nitrate, phosphomolybdic acid, boron nitrate and mixtures thereof.

The content of compound(s), such as this(these) nitrate(s) and other compound(s) leading during calcination to "tacky-"oxide(s), in the effluent, expressed as oxide, based on the total mass of the salts, including the nitrates, contained in the effluent, also expressed as oxides, is generally greater than 35% by mass.

Indeed the method according to the invention in particular, gives the possibility of calcination of effluents having a high content of nitrates and other compounds, so-called "tacky compounds", i.e. greater than 35% by mass expressed as oxides.

In a particularly advantageous way, the method according to the invention allows calcination of solutions with a high sodium content, which are highly tacky.

By "high content"of sodium, more specifically of sodium nitrate, is generally meant that the effluent has a sodium nitrate content expressed as a sodium oxide $Na_2O$, based on the total mass of the salts, including the nitrates, contained in the effluent, expressed as oxides, greater than 30% by mass, preferably greater than 50% by mass.

The conditions of the calcination step are known to the man skilled in the art in this technical field and may easily be adapted depending on the nature of the treated effluents.

The conditions of this calcination, except for the notable fact that any clogging is avoided, are not fundamentally modified by applying the specific calcination adjuvant according to the invention.

The conditions of the calcination are generally the following: temperature reached by the calcinate of about 400° C., speed of rotation of the tube 10 to 40 rpm, addition of a calcination adjuvant for example of the sugar type.

This calcination step is generally carried out in a heated rotating tube, for example a rotating tube heated by an electric oven with several independent heating areas. Some heating areas are more particularly dedicated to evaporation and other ones to calcination.

The calcination areas allow the calcinate to be heated to a temperature of about 400° C.

The speed of rotation of the tube, the addition of the calcination adjuvant and the presence of a loose bar allow the solid calcinate to be split up so that the latter may react under good conditions in the vitrification unit.

The treatment method according to the invention generally comprises after the calcination step, a step for vitrification of the calcinate obtained during this calcination step. This vitrification step consists in a reaction between the calcinate and a glass frit (preformed glass) in order to obtain a confinement, containment glass.

In other words, after the calcination step, a vitrification step is carried out which consists of elaborating a confinement glass from the melting of the calcinate produced during the calcination step with a glass frit.

As this was already specified above, the application in the dilution adjuvant of specific nitrates of iron and of rare earths gives the possibility of relaxing the constraints, requirements, as to the formulation of the glass. In particular, it is possible to incorporate a greater proportion of effluent into the glass when the calcinate was obtained by using the dilution adjuvant according to the invention in the place of and instead of a dilution adjuvant only consisting of aluminium nitrate.

In other words, the restricting limit on the incorporation level of effluents in the glass, due to aluminium nitrate, is suppressed and the incorporation level is significantly increased and for example passes from 13% by mass of oxides to 18% by mass of oxides, based on the total mass of the glass.

Further, the significant provision of aluminium in the case of a dilution adjuvant only consisting of aluminium nitrate tends to harden the calcinate and has the consequence of causing lowering of the reactivity between the calcinate and the glass frit in the vitrification oven.

On the contrary, addition of iron makes the calcinate more friable and therefore more easy to vitrify.

The vitrification consists in a melting reaction between the calcinate and the glass frit in order to form a confinement, containment, glass.

It is carried out in two types of oven: indirect induction ovens which consist of heating with four inductors a metal pot, can, into which the frit/calcinate mixture is fed, and direct induction ovens which consist of heating the glass with an inductor through a cooled structure (cold crucible) which lets through a portion of the electromagnetic field and into which the frit/calcinate mixture is fed continuously.

The invention will now be described with reference to the following examples given as an illustration and not as a limitation.

EXAMPLE 1

Comparative

In this example, the calcination of an effluent containing a high sodium nitrate content is described.

The composition of this effluent (waste) is given in Table 1, this composition being expressed in mass % of the oxides corresponding to the salts contained in the effluent, which are in majority nitrates.

The percentage of the oxides is expressed based on the total mass of the oxides corresponding to the salts contained in the effluent.

The effluent described in Table 1 below is highly loaded especially with sodium and is therefore very tacky.

An adjuvant (adjuvant 1) of the prior art which consists of 100% by mass of aluminium nitrate expressed as oxide $Al_2O_3$ is added to this effluent.

The conditions of the calcination are the following:

A calciner with four independent heating areas, the temperature reached by the calcinate is of about 400° C., the speed of rotation of the rotating tube containing the loose bar is 20 rpm, the content of calcination adjuvant is 40 g/L of the mixture of the effluent with the dilution adjuvant.

EXAMPLE 2

In this example, the calcination of the same effluent as the one in Example 1 and described in Table 1 is carried out.

An adjuvant (adjuvant 2) according to the invention which consists of 75% by mass of aluminium nitrate expressed as oxide $Al_2O_3$ and of 25% by mass of iron nitrate expressed as oxide $Fe_2O_3$ is added to this effluent.

The conditions of this calcination are the same as those of example 1.

TABLE 1

| Compound | Waste (mass %) | Adjuvant 1 (mass %) | Adjuvant 2 (mass %) |
|---|---|---|---|
| $Al_2O_3$ | | 100.00 | 75.00 |
| BaO | 2.98 | | |
| $Na_2O$ | 56.43 | | |
| $Cr_2O_3$ | 0.56 | | |
| NiO | 0.48 | | |
| $Fe_2O_3$ | 1.63 | | 25.00 |
| $MnO_2$ | 1.61 | | |
| $La_2O_3$ | 0.44 | | |
| $Nd_2O_3$ | 3.45 | | |
| $Ce_2O_3$ | 6.24 | | |
| $ZrO_2$ | 8.23 | | |
| $MoO_3$ | 5.71 | | |
| $P_2O_5$ | 3.49 | | |
| $RuO_2$ | 1.00 | | |
| $B_2O_3$ | 6.13 | | |
| $SO_3$ | 1.61 | | |
| | 100.00 | | |

EXAMPLE 3

Comparative

In this example, vitrification of the calcinate obtained in the comparative example 1 is carried out.

Let us recall that this calcinate was prepared by using an adjuvant ("adjuvant No. 1") only consisting of aluminium nitrate.

The elaboration of a glass from the calcinate and from a glass frit containing 1% by mass of alumina, the proportion of frit in the glass being of 77.43%, leads to a 11.6% maximum incorporation level of the initial waste into the glass by the following calculation ((100−51,27))*(13−1)/(51,27−1)).

EXAMPLE 4

In this example, it is proceeded with vitrification of the calcinate obtained in Example 2 according to the invention.

Let us recall that this calcinate was prepared by using an adjuvant ("adjuvant No. 2") consisting of 75% by mass of aluminium salt and of 25% by mass of iron salt.

It was determined that the maximum incorporation level of the initial waste (therefore before mixing) is limited to 11.6% of the mass of the glass in the comparative example 3, while in Example 4, the maximum incorporation level is 15.6%.

Further, the substantial provision of aluminium by the adjuvant No. 1 tends to harden the calcinate and has the consequence of causing a slight lowering of reactivity between the calcinate and the glass frit in the vitrification oven.

On the contrary, providing iron with the adjuvant No. 2 according to the invention, makes the calcinate more friable and therefore more easy to vitrify.

EXAMPLE 5

In this example, the calcination of an effluent is described, consisting of 100% sodium nitrate as described in Table 2.

In a first experiment, an adjuvant (adjuvant 1) of the prior art which consists of 100% by mass of aluminium nitrate expressed as oxide $Al_2O_3$ is added to this effluent.

In a second experiment, the calcination of the sodium nitrate was carried out with an adjuvant (adjuvant 3) according to the invention in which a portion of the aluminium nitrate was replaced with a mixture of lanthanum, cerium, neodymium and praseodymium nitrates.

For both cases, the sodium nitrate content expressed as a total mass of oxide represents 30% in the mixture of the effluent with the dilution adjuvant.

The calcination conditions are the following:

Calciner with two independent heating areas, the temperature reached by the calcinate is about 350° C., the speed of rotation of the rotating tube containing the loose bar is 35 rpm, the calcination adjuvant content is 20 g/L of the mixture of the effluent with the dilution adjuvant.

TABLE 2

| | Effluent (%) | Adjuvant 1 (%) | Adjuvant 3 (%) |
|---|---|---|---|
| $Na_2O$ | 100 | | |
| $Al_2O_3$ | | 100 | 38.05 |
| $La_2O_3$ | | | 8.65 |
| $Nd_2O_3$ | | | 28.56 |
| $Ce_2O_3$ | | | 16.78 |
| $Pr_2O_3$ | | | 7.95 |

The invention claimed is:

1. A method for treating a nitric aqueous liquid effluent containing nitrates of metals or metalloids, comprising a step for calcination of the effluent in order to convert the nitrates of metals or metalloids into oxides of said metals or metalloids, at least one compound selected from the nitrates of metals or metalloids and the other compounds of the effluent leading upon calcination to a tacky oxide, and a dilution adjuvant leading upon calcination to a non-tacky oxide being added to the effluent prior to the calcination step, wherein the dilution adjuvant comprises aluminium nitrate and at least one other nitrate selected from iron nitrate and rare earth nitrates.

2. The method according to claim 1, wherein the dilution adjuvant comprises aluminium nitrate and at least one other nitrate selected from iron nitrate, lanthanum nitrate, cerium nitrate, praseodymium nitrate and neodymium nitrate.

3. The method according to claim 1, wherein said at least one compound leading upon calcination to tacky oxide(s) is selected from sodium nitrate, phosphomolybdic acid, boron nitrate, and mixtures thereof.

4. The method according to claim 1, wherein the content of compound(s) leading upon calcination to tacky oxide(s) expressed as oxides, based on the total mass of the salts contained in the effluent, expressed as oxides, is greater than 35% by mass.

5. The method according to claim 3, wherein the effluent has a sodium nitrate content, expressed as sodium oxide $Na_2O$, based on the total mass of the salts contained in the effluent, expressed as oxides, greater than 30 % by mass, preferably greater than 50 % by mass.

6. The method according to claim 1, wherein the calcination step is carried out in a heated rotating tube allowing the calcinate to attain a temperature of about 400° C.

7. The method according to claim 1, wherein after the calcination step, a vitrification step is carried out which consists of elaborating a confinement glass from the melting of the calcination produced during the calcination step with a glass frit.

* * * * *

UNITED STATES PATENT AND TRADEMARK OFFICE

CERTIFICATE OF CORRECTION

PATENT NO. : 8,604,264 B2
APPLICATION NO. : 13/142804
DATED : December 10, 2013
INVENTOR(S) : Ledoux et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 192 days.

Signed and Sealed this
Twenty-second Day of September, 2015

Michelle K. Lee

Michelle K. Lee
*Director of the United States Patent and Trademark Office*